US009672463B2

(12) United States Patent
Jeon et al.

(10) Patent No.: US 9,672,463 B2
(45) Date of Patent: Jun. 6, 2017

(54) PEOPLE COUNTING METHOD AND APPARATUS

(71) Applicant: HANWHA TECHWIN CO., LTD., Changwon-si (KR)

(72) Inventors: Ki Yong Jeon, Changwon-si (KR); Jong Kyoung Lee, Changwon-si (KR)

(73) Assignee: Hanwha Techwin Co., Ltd., Changwon-si (KR)

( * ) Notice: Subject to any disclaimer, the term of this patent is extended or adjusted under 35 U.S.C. 154(b) by 380 days.

(21) Appl. No.: 14/204,146

(22) Filed: Mar. 11, 2014

(65) Prior Publication Data

US 2015/0124923 A1 May 7, 2015

(30) Foreign Application Priority Data

Nov. 7, 2013 (KR) ..... 10-2013-0134989
Dec. 5, 2013 (KR) ..... 10-2013-0150837

(51) Int. Cl.
*G06M 11/00* (2006.01)

(52) U.S. Cl.
CPC ..... *G06M 11/00* (2013.01)

(58) Field of Classification Search
CPC ..... G06M 1/00; G06M 11/00
USPC ..... 377/6, 10, 11, 12
See application file for complete search history.

(56) References Cited

U.S. PATENT DOCUMENTS 4,023,135 A * 5/1977 Hanmura ..... G01S 15/04 367/93
4,112,419 A * 9/1978 Kinoshita ..... B66B 1/3476 187/392
4,303,851 A * 12/1981 Mottier ..... G07C 9/00 377/45
4,356,387 A * 10/1982 Tsubota ..... G07C 9/00 250/221
4,870,663 A 9/1989 Kulju et al.
6,754,368 B1 * 6/2004 Cohen ..... G01S 7/4008 348/143
7,026,978 B2 * 4/2006 Okamura ..... G01S 13/04 342/157

FOREIGN PATENT DOCUMENTS

JP 2011-186584 A 9/2011
KR 2001-0113663 A 12/2001
KR 10-1116279 B1 3/2012

* cited by examiner

*Primary Examiner* — Patrick O'Neill
(74) *Attorney, Agent, or Firm* — Sughrue Mion, PLLC

(57) ABSTRACT

An apparatus configured to count people in a target area includes a wireless transceiver and a controller. The wireless transceiver is configured to radiate an impulse electromagnetic wave to the target area and receive a reflection signal from the target area, and the controller is configured to obtain a signal strength of the reflection signal over a reception time period during which the reflection signal is received and count people according to the signal strength, considering that the signal strength is weakened in proportion to the reception time period.

4 Claims, 16 Drawing Sheets

1901

| PHASE-SHIFTING VALUE | X-COORDINATE | Y-COORDINATE | DETERMINATION RESULT |
|---|---|---|---|
| 0 | 0 | 0 | 0 |
| 1 | 0 | 1 | 0 |
| 2 | 0 | 2 | 1 |
| ... | ... | ... | ... |

2001

| | | | | | | | | | |
|---|---|---|---|---|---|---|---|---|---|
| 1 | 1 | 0 | 0 | 0 | 0 | 0 | 0 | 0 | 0 |
| 1 | 1 | 0 | 0 | 0 | 0 | 0 | 0 | 0 | 0 |
| 0 | 0 | 0 | 0 | 0 | 0 | 1 | 1 | 1 | 0 |
| 0 | 0 | 0 | 0 | 0 | 0 | 1 | 1 | 1 | 0 |
| 0 | 0 | 0 | 0 | 0 | 0 | 1 | 1 | 1 | 0 |
| 1 | 1 | 1 | 0 | 0 | 0 | 1 | 1 | 0 | 0 |
| 0 | 1 | 1 | 0 | 0 | 0 | 0 | 0 | 0 | 0 |
| 0 | 1 | 1 | 0 | 0 | 0 | 0 | 0 | 0 | 0 |

PEOPLE COUNTING METHOD AND APPARATUS

CROSS-REFERENCE TO RELATED APPLICATIONS

This application claims the benefit of Korean Patent Application No. 10-2013-0134989, filed on Nov. 7, 2013, and Korean Patent Application No. 10-2013-0150837, filed on Dec. 5, 2013, in the Korean Intellectual Property Office, the disclosures of which are incorporated herein in their entirety by reference.

BACKGROUND

1. Field

One or more exemplary embodiments relate to a people counting method and apparatus, and more particularly, to a method of counting people in a target area and a people counting apparatus using the method.

2. Description of the Related Art

Conventionally, a people counting apparatus employs a sensor installed on a door. However, such a people counting apparatus counts only people entering a space and does not count people in an unspecified target area at the same time.

Accordingly, a camera apparatus may also be used for counting people in a target area. In other words, people may be counted by using a technology such as facial recognition by using a camera. However, such a conventional people counting method and apparatus may have the following problems.

First, according to an environment of a target area, a case in which people may not be counted may frequently occur. For example, it may not be possible to count people by photographing in an area near an accident, such as an area near a fire or an area experiencing a blackout.

Second, counting people by using a camera may make people feel uncomfortable.

SUMMARY

One or more exemplary embodiments include a people counting method and apparatus able to operate regardless of an environment of a target area and without making people feel uncomfortable.

Additional aspects will be set forth in part in the description which follows and, in part, will be apparent from the description, or may be learned by practice of the presented exemplary embodiments.

According to one or more exemplary embodiments, a method of counting people in a target area includes operations (a) through (c).

In operation (a), an impulse electromagnetic wave may be radiated to the target area and a reflection signal may be received from the target area.

In operation (b), a signal strength of the reflection signal may be obtained over a reception time period during which the reflection signal is received.

In operation (c), people may be counted according to the signal strength, by considering that the signal strength is weakened in proportion to the reception time period.

Operation (c) may include operations (c1) and (c2).

In operation (c1), weakening of a signal strength of the reflection signal in proportion to the reception time period may be compensated for, and a compensation reflection signal obtained as a result of the compensating may be generated.

In operation (c2), a number of times when a signal strength of the compensation reflection signal exceeds a set threshold value may be determined as a number of the people.

In operation (c), a variable threshold value that is inversely proportional to the reception time period may be set, and a number of times when the signal strength exceeds the variable threshold value may be determined as a number of people.

In operation (a), a phase-array antenna may be used to receive the reflection signal from the target area.

According to one or more exemplary embodiments, an apparatus configured to count people in a target area includes a wireless transceiver and a controller.

The wireless transceiver may radiate an impulse electromagnetic wave to the target area and receive a reflection signal from the target area.

The controller may be configured to obtain a signal strength of the reflection signal over a reception time of the reflection signal, and count people according to the signal strength, by considering that the signal strength is weakened in proportion to the reception time period.

The wireless transceiver may include a phased-array antenna configured to receive the reflection signal from the target area.

The wireless transceiving unit may include an impulse signal generator, a transmission amplifier, a transmission antenna, the phased-array antenna, a phase shifter, a reception amplifier, and an analog-to-digital converter (ADC).

The impulse signal generator may be configured to generate an impulse signal in an ultra-wide band (UWB) according to a digital pulse signal received from the controller.

The transmission amplifier may be configured to amplify an impulse signal received from the impulse signal generator.

The transmission antenna may be configured to radiate the impulse electromagnetic wave to the target area, according to the amplified impulse signal received from the transmission amplifier.

The phase shifter may be configured to output a reflection signal that is received from the phased-array antenna to a reception amplifier while driving the phased-array antenna according to a phase-shifting value that is received from the controller.

The reception amplifier may be configured to amplify the reflection signal that is received from the phase shifter, and output the amplified reflection signal to the analog-to-digital converter (ADC).

The ADC may be configured to convert the amplified reflection signal received from the reception amplifier into a digital signal, and output the digital signal to the controller.

The wireless transceiver may further include an impulse signal generator, a transmission amplifier, a circulator, a phase shifter, the phased-array antenna, a reception amplifier, and an ADC.

The transmission amplifier may be configured to amplify an impulse signal received from the impulse signal generator.

The circulator may be configured to output the amplified impulse signal received from the transmission amplifier to a phase shifter, and output a reflection signal received from the phase shifter to a reception amplifier.

The phase shifter may be configured to output the amplified impulse signal received from the circulator to the phased-array antenna and output a reflection signal received from the phased-array antenna to the circulator, while driving the phased-array antenna according to a phase-shifting value that is received from the control unit.

The reception amplifier may be configured to amplify the reflection signal that is received from the circulator, and output the reflection signal to the ADC.

The ADC may be configured to convert the amplified reflection signal received from the reception amplifier into a digital signal, and output the digital signal to the controller.

BRIEF DESCRIPTION OF THE DRAWINGS

These and/or other aspects will become apparent and more readily appreciated from the following description of the exemplary embodiments, taken in conjunction with the accompanying drawings in which.

DETAILED DESCRIPTION

Figure 1:
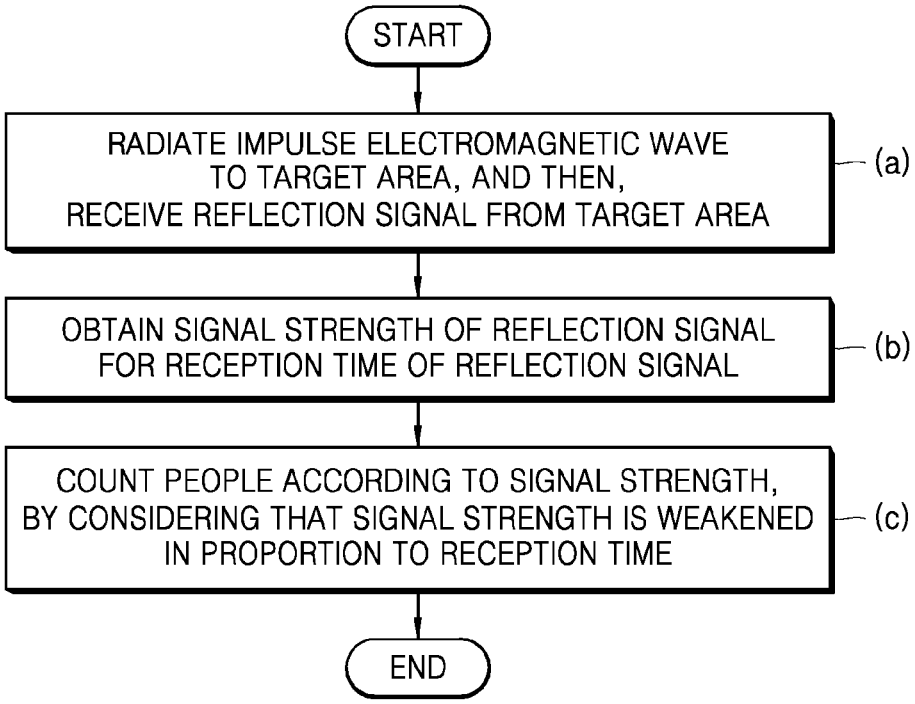
FIG. 1 is a flowchart of a people counting method according to an exemplary embodiment.

Reference will now be made in detail to exemplary embodiments, examples of which are illustrated in the accompanying drawings, wherein like reference numerals refer to like elements throughout. In this regard, the exemplary embodiments may have different forms and should not be construed as being limited to the descriptions set forth herein. Accordingly, the exemplary embodiments are described below, by referring to the figures, to explain aspects of the present disclosure.

The following description and accompanying drawings are provided for a better understanding of the present disclosure. In the following description, well-known functions or constructions are not described in detail if it is determined that they would obscure the disclosure due to unnecessary detail.

The following description and drawings are not intended to restrict the scope of the disclosure. The terms used in the following description are merely used to describe particular exemplary embodiments and are not intended to limit the present disclosure.

Hereinafter, exemplary embodiments will be described in detail with reference to the accompanying drawings.

FIG. 1 is a flowchart of a people counting method according to an exemplary embodiment.

Referring to FIG. 1, according to an exemplary embodiment, the people counting method is used to count people in a target area and includes operations (a) through (c).

In operation (a), after an impulse electromagnetic wave is radiated to a target area, a reflection signal is received from the target area.

In the current exemplary embodiment, the impulse electromagnetic wave radiated to the target area is an ultra-wide band (UWB) wave with a waveform having a frequency band ranging from 3 to 10 GHz. Accordingly, the following advantages may be obtained.

First, the impulse electromagnetic wave has a high penetrability, and thus, may not be affected by an obstacle.

Second, the impulse electromagnetic wave is not affected by interference caused by nearby signals.

Third, power consumption is reduced.

In operation (b), a signal strength of the reflection signal is obtained during a reception time of the reflection signal.

In operation (c), people are counted according to the signal strength, by considering that the signal strength is weakened in proportion to the reception time.

Figure 2:
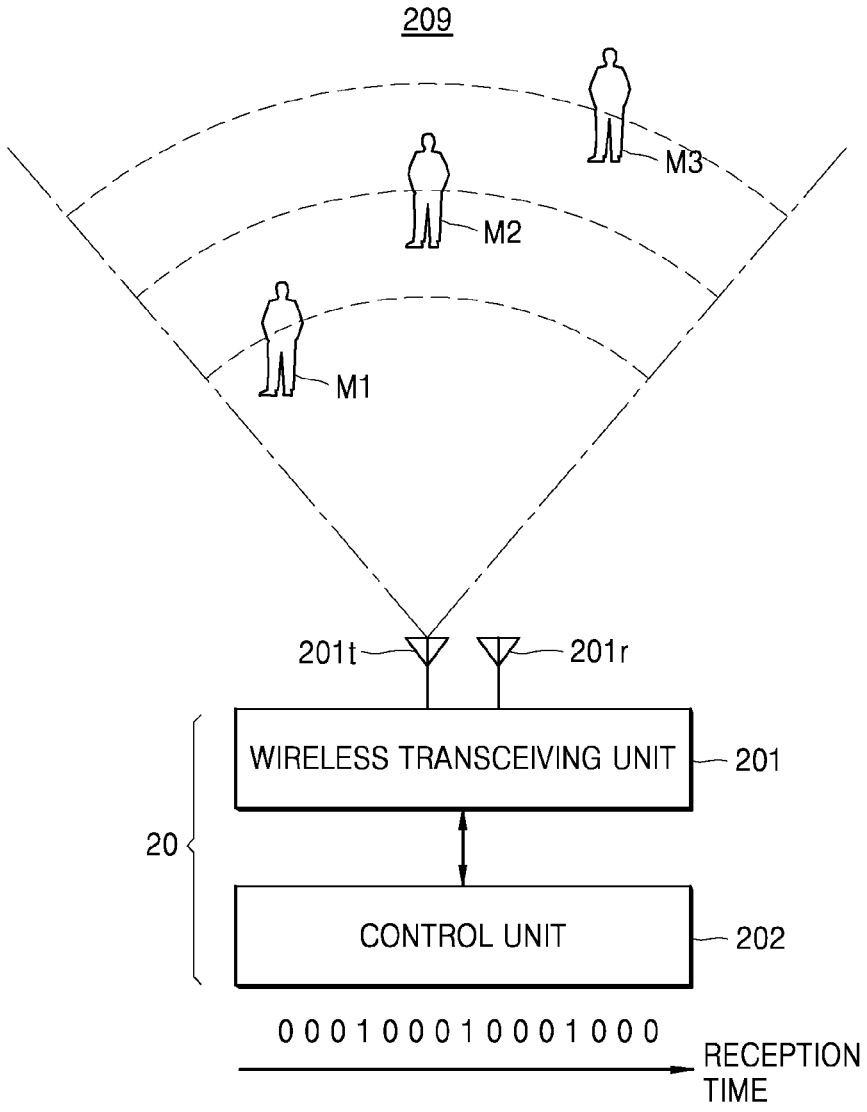
FIG. 2 is a diagram of a people counting apparatus using the people counting method shown in FIG. 1, according to an exemplary embodiment.

FIG. 2 is a diagram of a people counting apparatus 20 using the people counting method, shown in FIG. 1, according to an exemplary embodiment.

Referring to FIG. 2, according to an exemplary embodiment, the people counting apparatus 20 is an apparatus for counting people M1 through M3 in a target area 209, and includes a wireless transceiving unit 201 (e.g., wireless transceiver) and a control unit 202 (e.g., controller). It is understood that the people counting apparatus 20 may count more or less than three people.

The wireless transceiving unit 201 includes a transmission antenna 201*t* and a reception antenna 201*r*. The wireless transceiving unit 201 radiates an impulse electromagnetic wave to the target area 209 via the transmission antenna 201*t* and receives a reflection signal from the target area 209 via the reception antenna 201*r*.

The control unit 202 obtains a signal strength of the reflection signal during a reception time when the reflection signal is received from the reception antenna 201*r*, and counts the people M1 through M3 according to the signal strength, by considering that the signal strength is weakened in proportion to the reception time.

For example, as the control unit 202 obtains binary data "000100010001000" as a result of the counting, it may be understood that three people are present in the target area 209.

With regard to the people counting method and apparatus described with respect FIGS. 1 and 2, the people M1 through M3 are counted according to the strength of the reflection signal of the impulse electromagnetic wave received by the reception antenna 201*r*, by considering that the signal strength is weakened in proportion to the reception time.

A reception time of a reflection signal corresponds to a distance between the people counting apparatus 201 and people to be counted. Accordingly, in the exemplary embodiment, people may be counted by calculating the distance between the people counting apparatus 201 and the people M1 through M3.

In other words, according to an exemplary embodiment, people may be counted by using the reflection signal of the impulse electromagnetic wave, instead of using a conventional camera technology. Accordingly, the following effects may be obtained.

First, the people M1 through M3 may be counted regardless of an environment of an unspecified target area 209. For example, the people M1 through M3 may be counted even when they are in an area near an accident, such as an area experiencing a fire or a blackout.

Second, a problem of the conventional technology wherein people may feel uncomfortable during counting may be solved.

Figure 3:
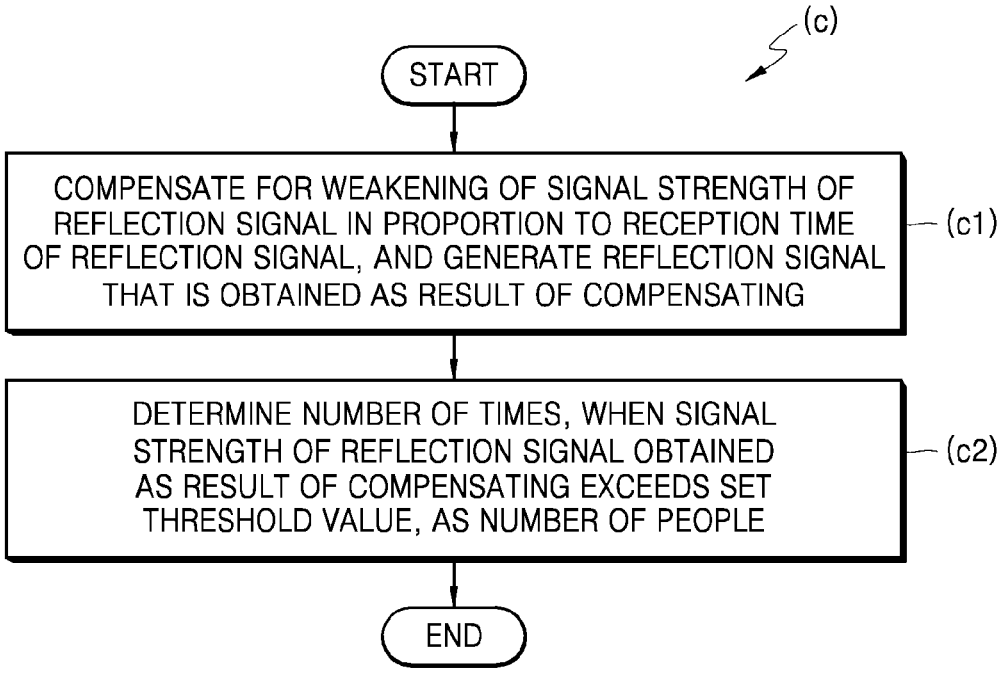
FIG. 3 is a flowchart of a first example of operation (c) of FIG. 1.
Figure 4:
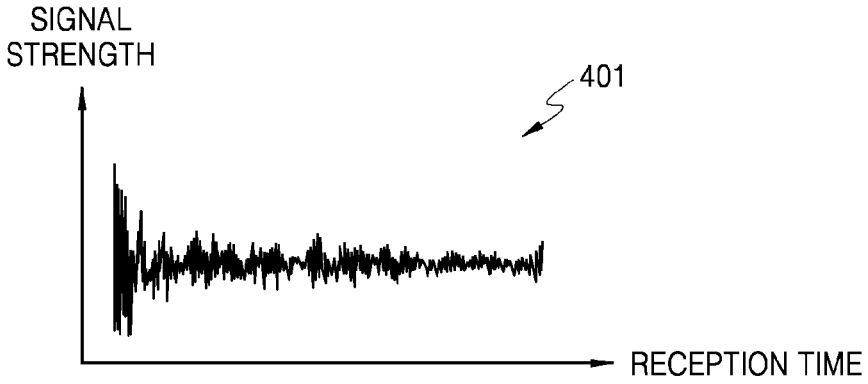
FIG. 4 is a waveform diagram for showing an example of a reflection signal that is received from a wireless transceiving unit of FIG. 2.
Figure 5:
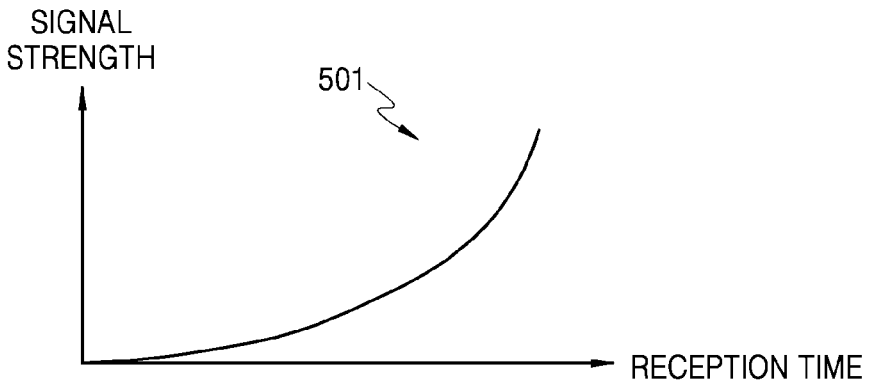
FIG. 5 is diagram for showing an example of a compensation signal to be applied to a reflection signal in operation (c1) of FIG. 3.

FIG. 3 is a flowchart of a first example of operation (c) of FIG. 1. FIG. 4 shows an example of a reflection signal 401 that is received from the wireless transceiving unit 201 shown in FIG. 2. FIG. 5 shows an example of a compensation signal to be applied to a reflection signal in operation (c1) of FIG. 3

Referring to FIGS. 2 through 5, the first example of operation (c) of FIG. 1 is as follows.

The wireless transceiving unit 201 converts the reflection signal 401 into a digital signal, and outputs the digital signal to the control unit 202. A signal strength of the reflection signal, input to the control unit 202, is weakened in proportion to a reception time.

In detail, the reception time is proportional to a distance between the people counting apparatus 20 and a reflecting object. Additionally, the strength of the received signal is inversely proportional to the biquadrate of a distance between the people counting apparatus 20 and a reflecting object.

Accordingly, a signal strength of the reflection signal, input to the control unit 202, is weakened in proportion to a reception time. For example, a signal strength of a reflection signal that corresponds to the third person M3 at a far distance is weaker than a signal strength of a reflection signal that corresponds to the second person M2 at a medium distance. Likewise, the signal strength of the reflection signal that corresponds to the second person M2 at a medium distance is weaker than a strength of a reflection signal that corresponds to the first person M1 at a close distance.

Accordingly, in operation (c1), the control unit 202 compensates for the weakening of a signal strength of the reflection signal 401 in proportion to a reception time, and thus, generates a reflection signal that is obtained as a result of the compensating (also referred to as a "compensation reflection signal").

In the current exemplary embodiment, the control unit 202 generates a reflection signal that is obtained as a result of the compensating by applying a compensation signal 501 to the reflection signal 401.

In operation (c2), the control unit 202 determines a number of times when a signal strength that is obtained as a result of compensating exceeds a set threshold value as a number of people. In this case, the set threshold value is constant regardless of a reception time.

Figure 6:
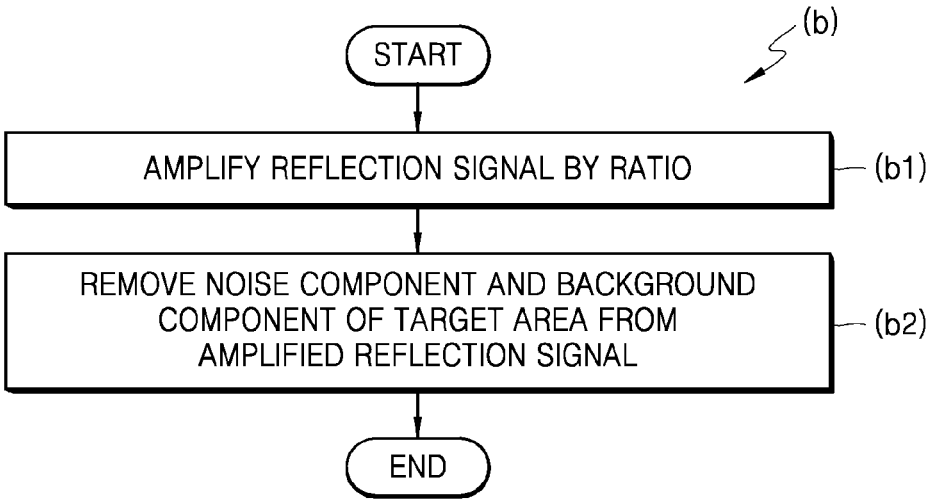
FIG. 6 is a flowchart of an example of operation (b) of FIG. 1.

FIG. 6 is a flowchart of an example of operation (b) of FIG. 1. Referring to FIGS. 2, 4, and 6, the example of operation (b) of FIG. 1 is as follows. According to an exemplary embodiment, the control unit 202 processes a digital signal, and a description thereof will not be repeated again.

In operation (b1), the wireless transceiving unit 202 amplifies a reflection signal by a ratio.

In operation (b2), a noise component and a background component of the target area 209 are removed from the amplified reflection signal. In the current exemplary embodiment, the wireless transceiving unit 200 removes a noise component from the amplified reflection signal. Additionally, the control unit 202 removes a background component of the target area 209 from the reception signal 401 from which a noise component is removed.

The background component of the target area 209, shown in operation (b2), is obtained as follows.

According to a manipulation executed by a user, when no people are present in the target area 209, the people counting apparatus 20 radiates an impulse electromagnetic wave to the target area 209, and receives a reflection signal from the target area 209.

Then, the people counting apparatus 20 obtains a background component of the target area 209 by amplifying the received reflection signal by a ratio. The obtained background component of the target area 209 is stored in the people counting apparatus 20.

As such, in order to obtain a signal strength of the reflection signal 401 for a reception time in operation (b), a background component is removed from the reflection signal 401, and thus, people may be counted more accurately.

Figure 7:
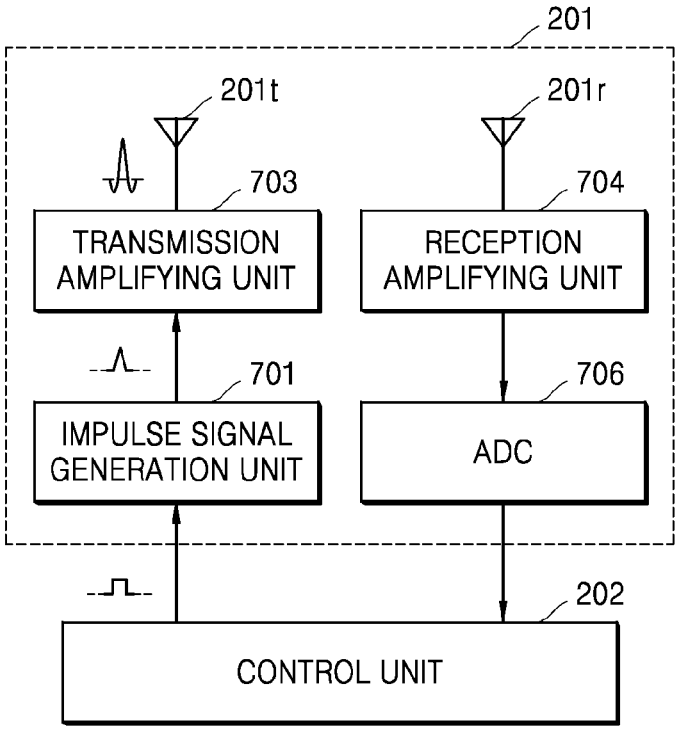
FIG. 7 is a diagram for showing a first example of the wireless transceiving unit of FIG. 2.

FIG. 7 is a diagram for showing a first example of the wireless transceiving unit 201 of FIG. 2. Like reference numerals shown in FIGS. 2 and 7 denote elements having the same function.

Referring to FIG. 7, the wireless transceiving unit 201 includes an impulse signal generation unit 701, a transmission amplifying unit 703, a transmission antenna 201*t*, a reception antenna 201*r*, a reception amplifying unit 704, and an analog-to-digital converter (ADC) 706.

If the control unit 202 generates a digital pulse signal, the impulse signal generation unit 701 generates an impulse signal in a UWB and having a waveform in which a frequency band ranges from 3 to 10 GHz.

The transmission amplifying unit 703 amplifies the impulse signal that is generated from the impulse signal generation unit 701, and outputs the impulse signal to the transmission antenna 201*t*.

Accordingly, an impulse electromagnetic wave is radiated to the target area 209 via the transmission antenna 201*t*.

Additionally, a reflection signal is received from the target area 209 via the reception antenna 201*r*.

Referring to FIG. 6, the reception amplifying unit 704, for example, a low-noise amplifier (LNA), amplifies the reflection signal received from the reception antenna 201*r* by a ratio, and removes a noise component from the amplified reflection signal.

The ADC 706 converts the reflection signal, from which the noise component is removed, into a digital signal, and outputs the digital signal to the control unit 202.

Figure 8:
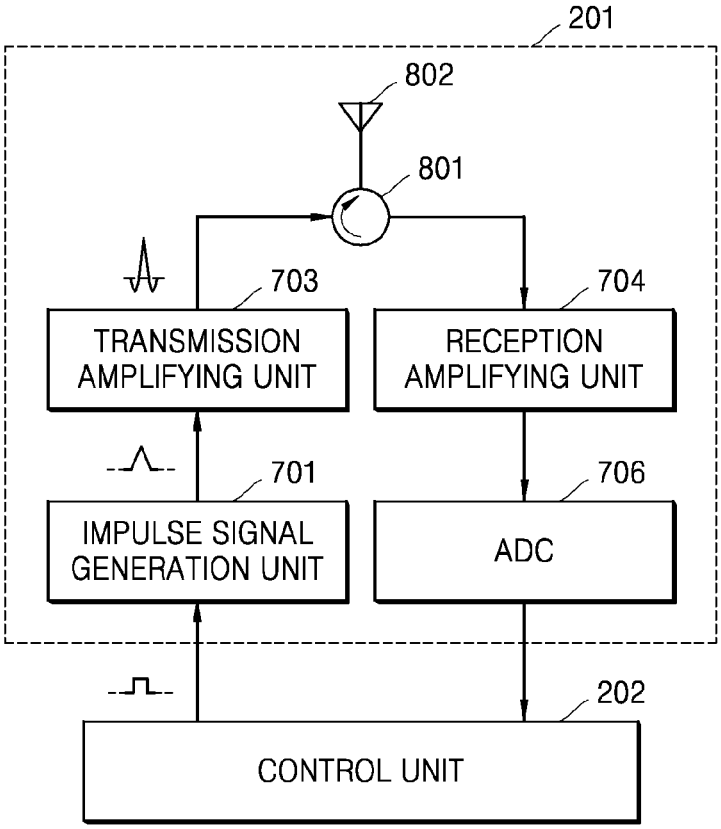
FIG. 8 is a diagram for showing a second example of the wireless transceiving unit of FIG. 2.

FIG. 8 shows a second example of the wireless transceiving unit 201 of FIG. 2. Like reference numerals shown in FIGS. 7 and 8 denote elements having the same function.

Thus, only a difference between the first example shown in FIG. 7 and the second example shown in FIG. 8 will be described.

A circulator 801 outputs an impulse signal, which is received from the transmission amplifying unit 703, to a transceiving antenna 801, and outputs a reflection signal, which is received from the transceiving antenna 801, to the reception amplifying unit 704. In other words, the circulator 801 may use the same transceiving antenna 801 to receive and transmit signals.

Figure 9:
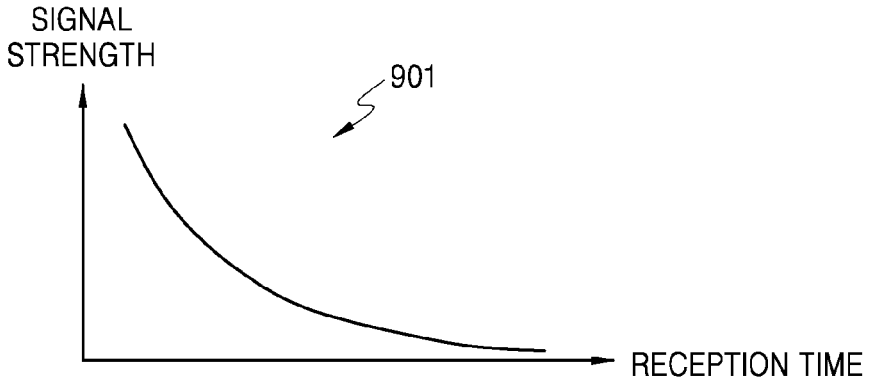
FIG. 9 is a graph for explaining a second example of operation (c) of FIG. 1.

FIG. 9 is a graph for explaining a second example of operation (c) of FIG. 1.

Referring to FIGS. 1, 2, and 9, with regard to the second example of operation (c), a variable threshold value 901 that is inversely proportional to a reception time is set for the control unit 202. Additionally, the control unit 202 determines a number of times when a signal strength exceeds the set variable threshold value 901 as a number of people.

According to the second example of operation (c) of FIG. 9, unlike the first example of operation (c) of FIG. 3, the control unit 202 uses the variable threshold value 901 to account for the weakening of a signal strength.

The example in FIG. 6 is applied to operation (b) of FIG. 1.

Figure 10:
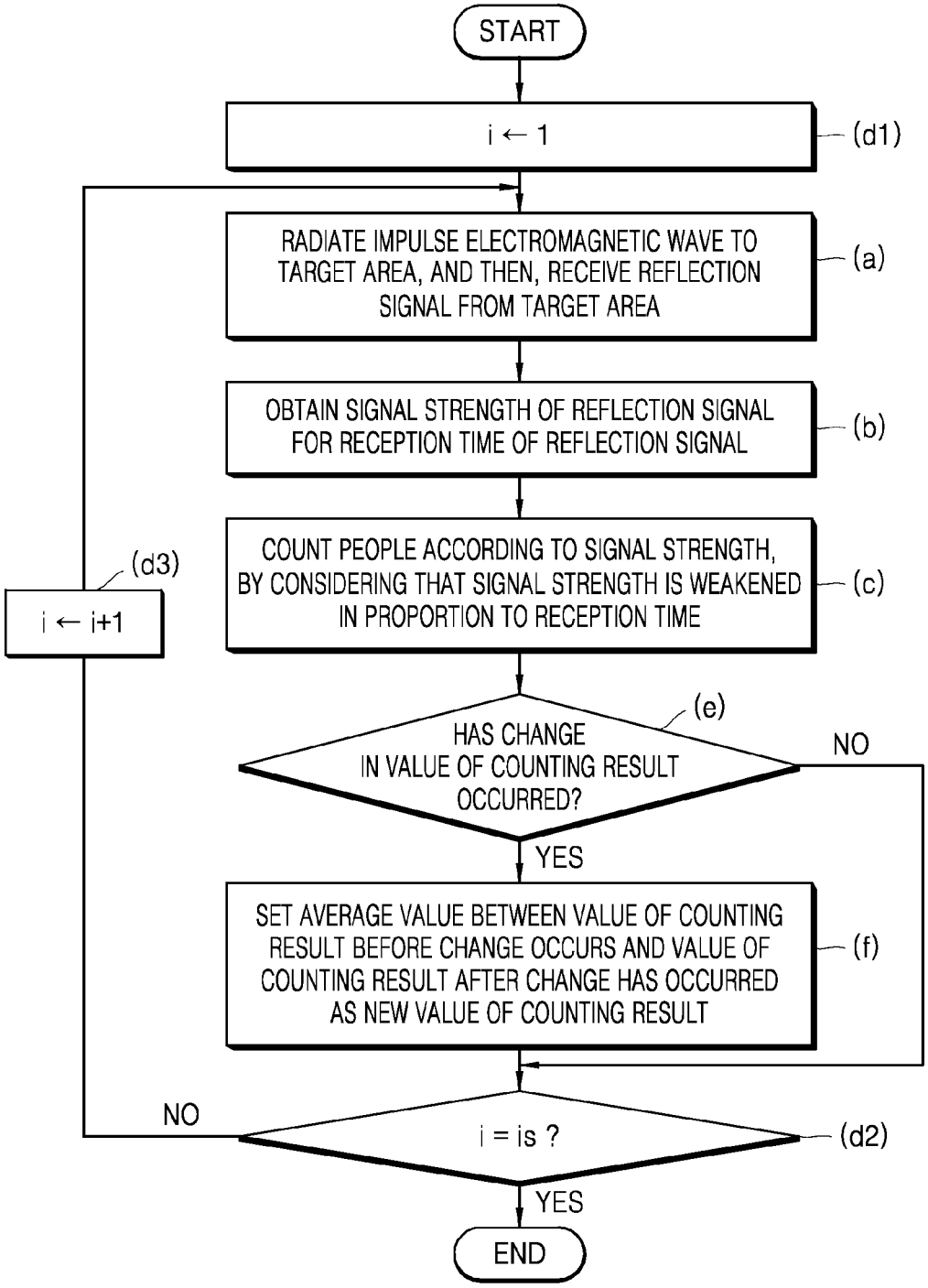
FIG. 10 is a flowchart of a people counting method according to another exemplary embodiment.

FIG. 10 shows a people counting method according to another exemplary embodiment. Like reference numerals shown in FIGS. 1 and 10 denote the same operations. Referring to FIGS. 2 and 10, according to another exemplary embodiment, the people counting method is as follows.

In operation (d1), the people counting apparatus 20 sets a variable i of a number of repetitions as 1.

In operation (a), the people counting apparatus 20 radiates an impulse electromagnetic wave to the target area 209, and receives a reflection signal from the target area 209.

As described above, the impulse electromagnetic wave radiated to the target area 209 is an impulse electromagnetic wave in a UWB and has a waveform with a frequency band ranging from 3 to 10 GHz.

In operation (b), the people counting apparatus 20 obtains a signal strength of the reflection signal during a reception time.

In operation (c), the people counting apparatus 20 counts the people M1 through M3 according to the signal strength, by considering that the signal strength is weakened in proportion to the reception time.

In operation (e), the people counting apparatus 20 determines whether a change in a value of a counting result has occurred.

In operation (f), if a change in the value of the counting result has occurred when operations a to c are repeated, the people counting apparatus 20 sets an average value between a value of a counting result before the change and a value of a counting result after the change as a new value of a counting result.

In operation (d2), the people counting apparatus 20 determines whether a value of the variable i of a number of repetition times is identical to a value of a number "is" of set repetition times.

If the variable i is not identical to the number "is", the variable i is increased by 1, and then, operations (a) and subsequent operations are performed again in operation (d3). In other words, operations (a) through (c) are repeatedly performed in correspondence with the number of set repetition times "is", according to operations (d1) through (d3).

According to the people counting method of another exemplary embodiment, an average value of values of counting results, which are obtained by performing repeated measurements, is set as a value of a final counting result. Accordingly, people may be counted more accurately by using the method shown in FIG. 10, than by using the method shown in FIG. 1.

Figure 11:
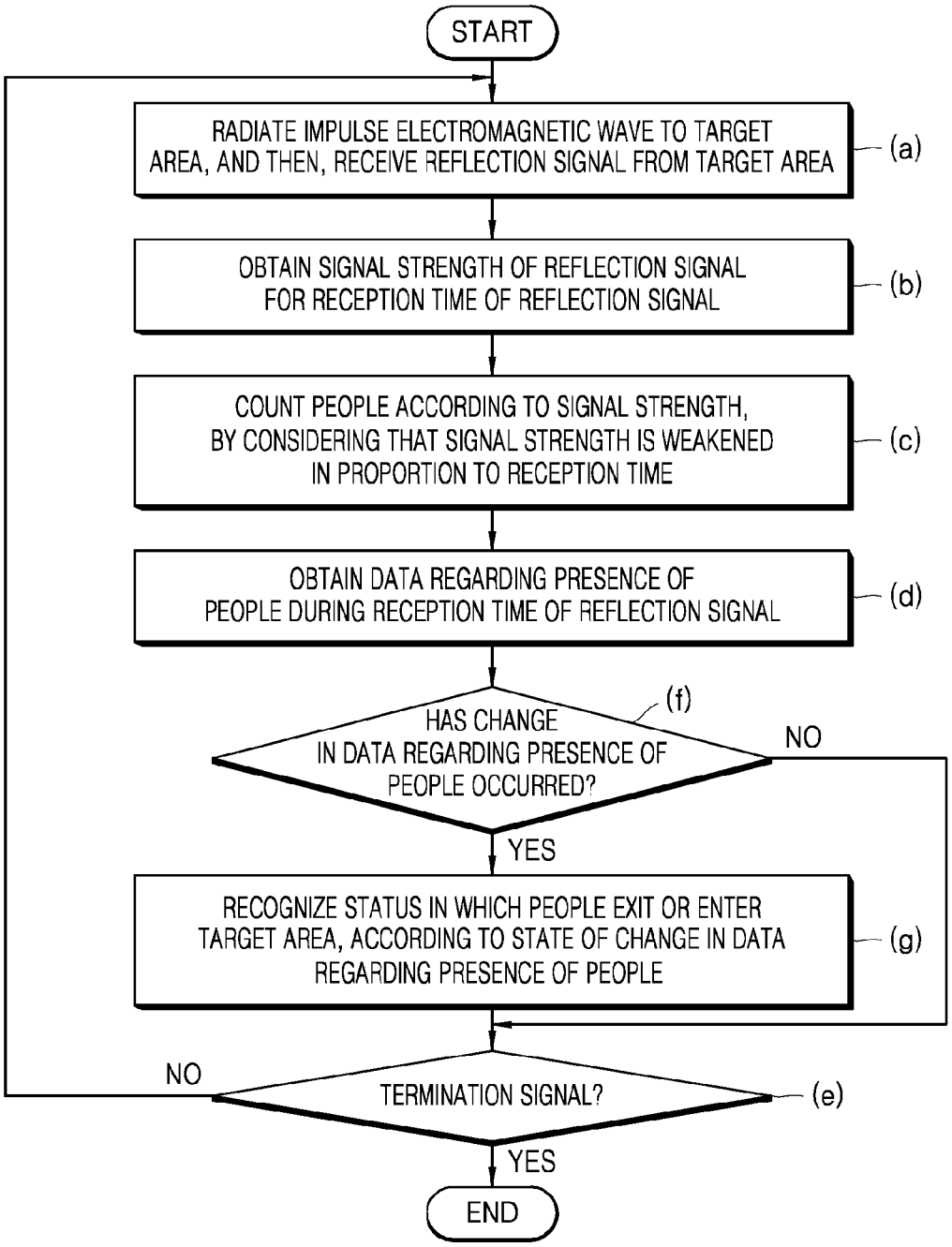
FIG. 11 is a flowchart of a people counting method according to another exemplary embodiment.
Figure 12:
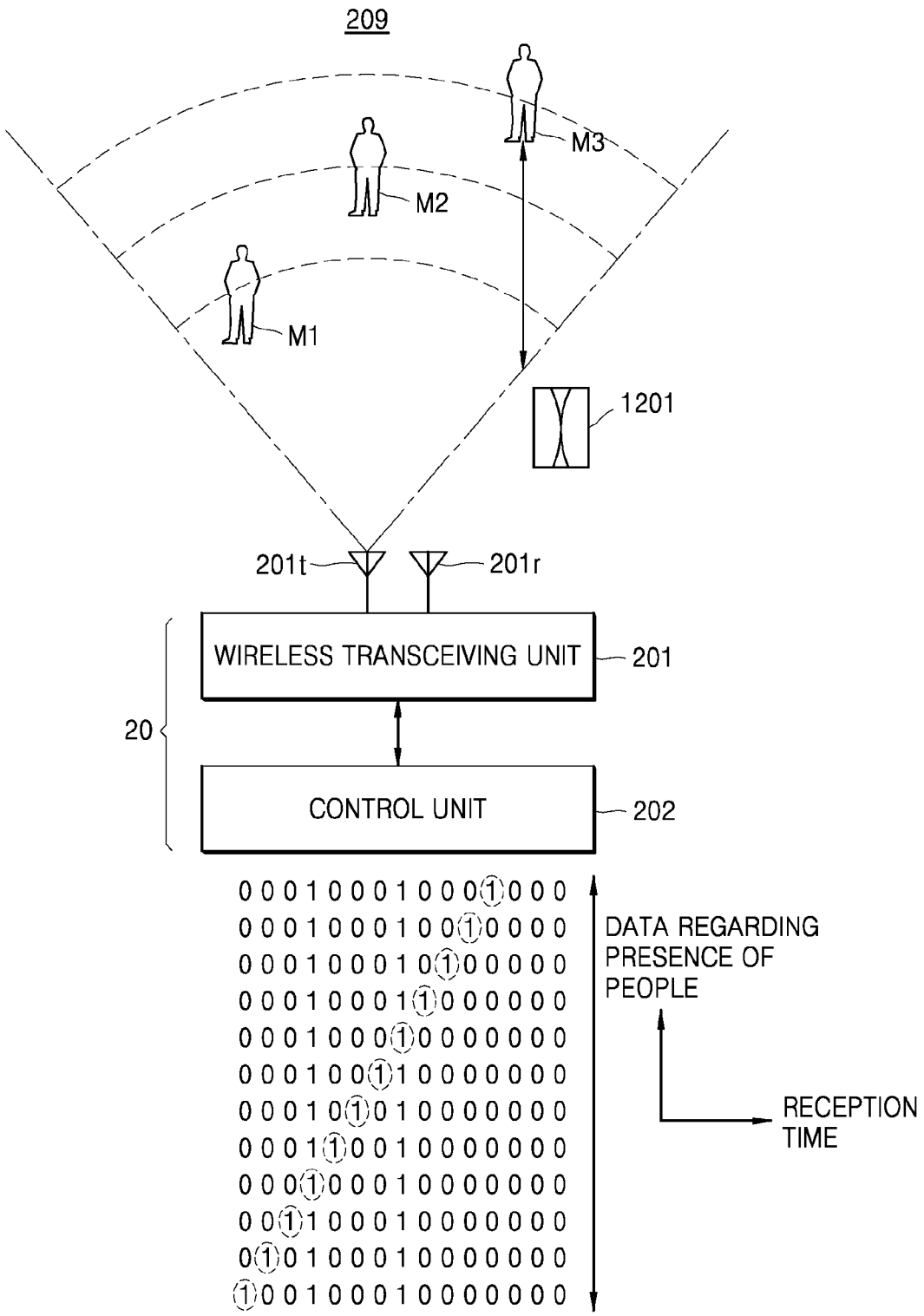
FIG. 12 is a diagram for explaining the people counting method shown in FIG. 11.

FIG. 11 shows a people counting method according to another exemplary embodiment. Like reference numerals shown in FIGS. 1 and 10 denote the same operations. FIG. 12 is a diagram for explaining the people counting method shown in FIG. 11. Like reference numerals shown in FIGS. 2 and 12 denote elements having a same function. A reference numeral 1201 shown in FIG. 12 denotes a door. Referring to FIGS. 11 and 12, the people counting method according to another exemplary embodiment is as follows.

In operation (a), the people counting apparatus 20 radiates an impulse electromagnetic wave to the target area 209 and receives a reflection signal from the target area 209.

As described above, the impulse electromagnetic wave radiated to the target area 209 is an impulse electromagnetic wave in a UWB and has a waveform with a frequency band ranging from 3 to 10 GHz.

In operation (b), the people counting apparatus 20 obtains a signal strength of the reflection signal for a reception time of the reflection signal.

In operation (c), the people counting apparatus 20 counts the people M1 through M3 according to the signal strength, by considering that the signal strength is weakened in proportion to the reception time.

In operation (d), referring to FIG. 12, the people counting apparatus 20 obtains data regarding a presence of the people M1 through M3 for the reception time of the reflection signal.

Then, in operation (f), the people counting apparatus 20 determines whether a change in the data regarding the presence of the people M1 through M3 has occurred after again performing operations (a) through (d).

Additionally, in operation (g), the people counting apparatus 20 recognizes a status when the people exit or enter the target area 209 according to a state of a change in the data regarding a presence of the people M1 through M3.

Operations (a) through (g) are repeatedly performed until a termination signal is generated.

Referring to FIG. 12, the data regarding the presence of the people M1 through M3 is constantly changed. Accordingly, the people counting apparatus 20 may recognize that the third person M3 moves from a point in the target area 209 to the door 1201, or the third person M3 moves from the door 1201 to a point in the target area 209. In other words, in operation (g), the people counting apparatus 20 recognizes a status when the people M1 through M3 exit or enter the target area 209 according to a state of a change in the data regarding presence of the people M1 through M3.

Thus, according to another exemplary embodiment, by using the people counting method shown in FIG. 11, a status when the people M1 through M3 exit or enter the target area 209 may be additionally recognized, compared to the people counting method shown in FIG. 1.

Figure 13:
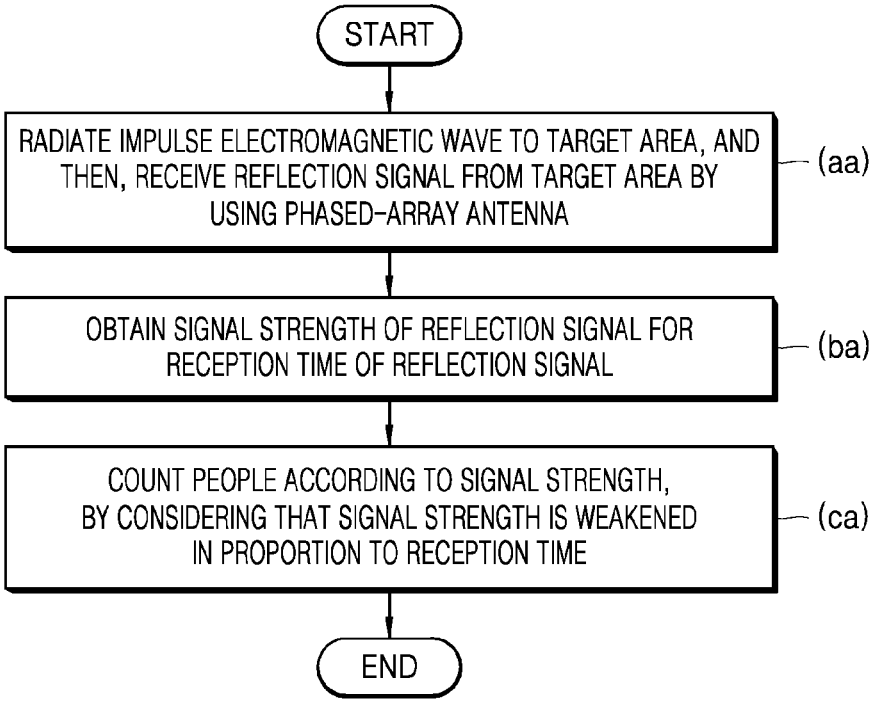
FIG. 13 is a flowchart of a people counting method according to another exemplary embodiment.

FIG. 13 is a flowchart of a people counting method according to another exemplary embodiment.

Referring to FIG. 13, the people counting method according to another exemplary embodiment is used to count people in a target area. The people counting method includes operations (aa) through (ca).

In operation (aa), a people counting apparatus radiates an impulse electromagnetic wave to the target area, and receives a reflection signal from the target area by using a phased-array antenna.

In the current exemplary embodiment, the impulse electromagnetic wave radiated to the target area is an impulse electromagnetic wave in a UWB and has a waveform with a frequency band ranging from 3 to 10 GHz. Of course, it is understood that other exemplary embodiments are not limited to radiating an impulse electromagnetic wave in a UWB and having a waveform with a frequency band ranging from 3 to 10 GHz, and may instead radiate many other types of waves.

In operation (ba), a signal strength of the reflection signal is obtained for a reception time of the reflection signal.

In operation (ca), people are counted according to the signal strength, by considering that the signal strength is weakened in proportion to the reception time.

Figure 14:
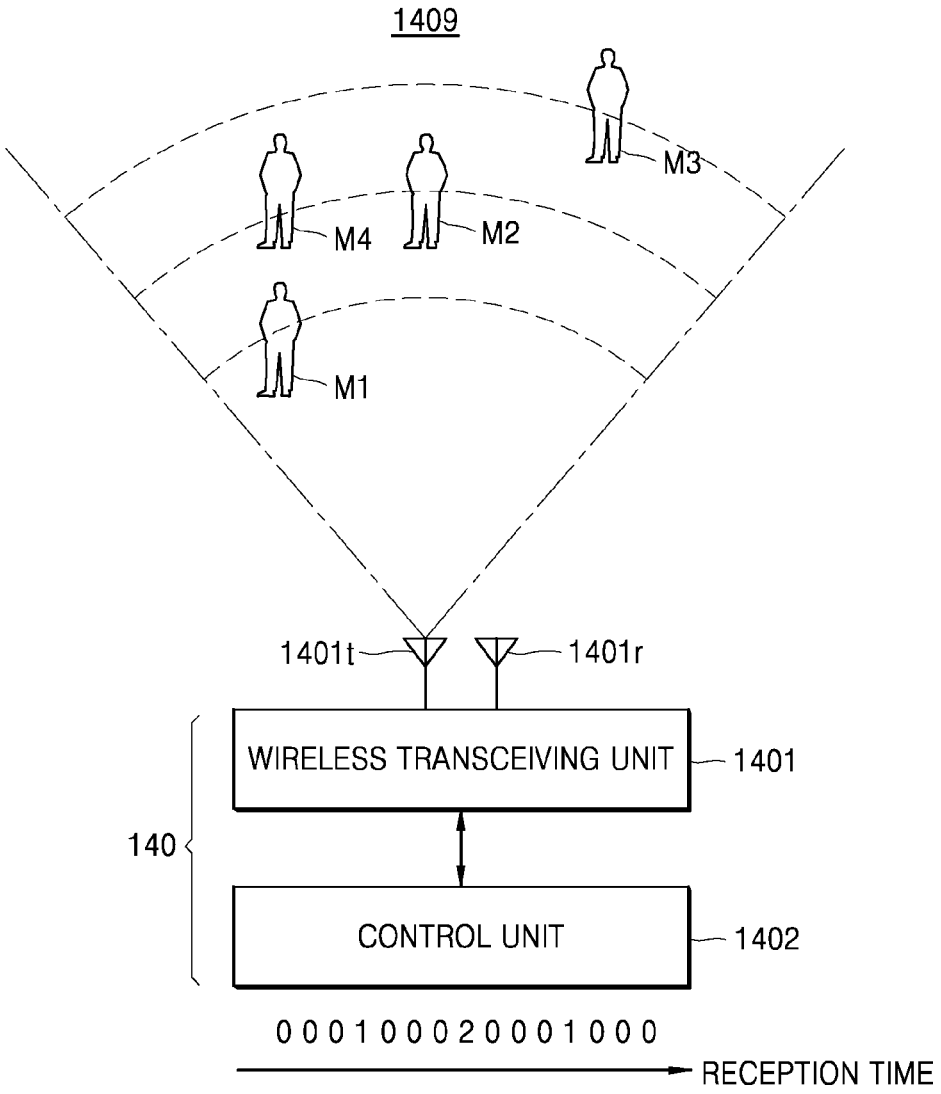
FIG. 14 is a diagram of a people counting apparatus using the people counting method shown in FIG. 13, according to another exemplary embodiment.

FIG. 14 is a diagram of a people counting apparatus 140 using the people counting method shown in FIG. 13, according to another exemplary embodiment.

Referring to FIG. 14, according to another exemplary embodiment, the people counting apparatus 140 is an apparatus for counting the people M1 through M3 in a target area 1409, and includes a wireless transceiving unit 1401 and a control unit 1402.

The wireless transceiving unit 1401 includes a transmission antenna 1401*t* and a phased-array antenna 1401*r*. The wireless transceiving unit 201 radiates an impulse electromagnetic wave to the target area 1409 via the transmission antenna 1401*t* and receives a reflection signal from the target area 1409 via the phased-array antenna 1401*r*.

The control unit 1402 obtains a signal strength of the reflection signal received from the phased-array antenna 1401*r* for a reception time of the reflection signal, and counts the people M1 through M3 according to the signal strength, by considering that the signal strength is weakened in proportion to the reception time.

For example, as the control unit 1402 obtains decimal data "000100010001000" as a result of the counting, it may be understood that four people M1 through M4 are present in the target area 209.

According to the people counting method and apparatus shown in FIGS. 13 and 14, the phased-array antenna 1401*r* is employed to receive a reflection signal from the target area 1409.

Accordingly, the phased-array antenna 1401*r* may be directed toward the target area 1409 and receive reflective signals respectively reflected from set divided areas. Accordingly, a plurality of the people M2 through M4, who are located at a same distance from the people counting apparatus 140, may be accurately counted, instead of counting only one person.

Descriptions with respect to FIGS. 3 through 6 and 9 also apply to the current exemplary embodiment. Thus, descriptions thereof will not be provided again.

Figure 15:
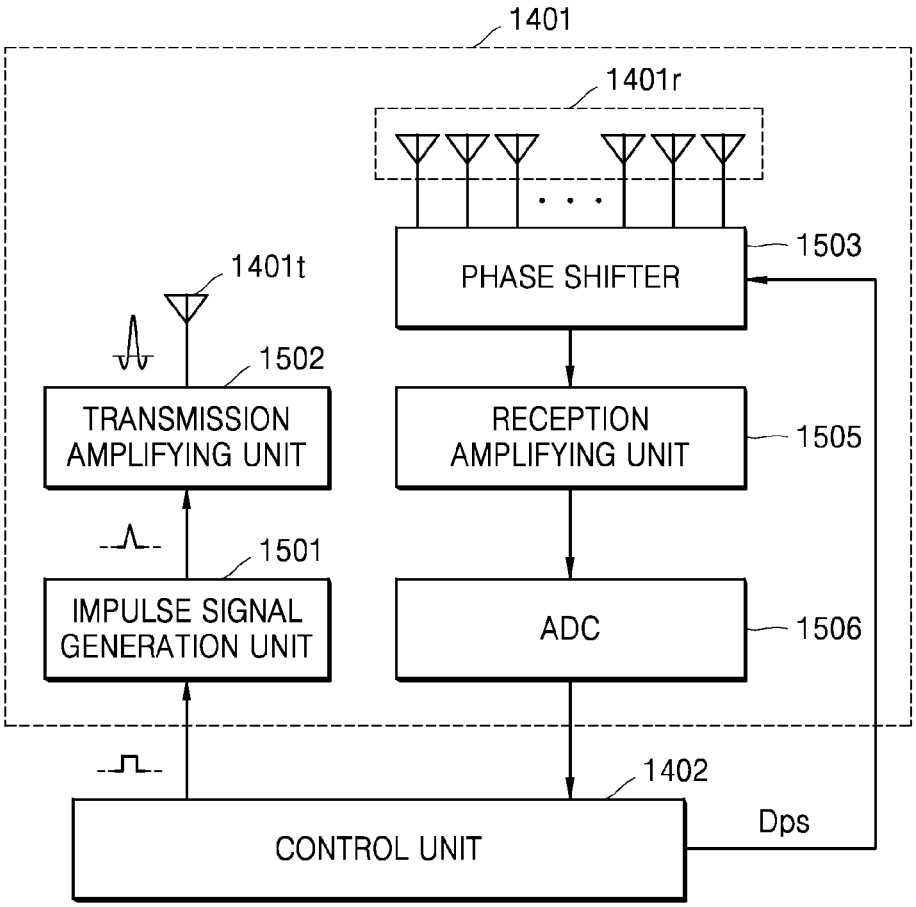
FIG. 15 is a diagram for showing a first example of a wireless transceiving unit of FIG. 14.

FIG. 15 is a diagram for showing a first example of the wireless transceiving unit 1401 shown in FIG. 14. Like reference numerals shown in FIGS. 14 and 15 denote elements having the same functions. Referring to FIG. 15, the first example of the wireless transceiving unit 1401 may be implemented as follows.

The wireless transceiving unit 1401 includes an impulse signal generation unit 1501 (e.g., impulse signal generator), a transmission amplifying unit 1502 (e.g., transmission amplifier), the transmission antenna 1401*t*, the phased-array antenna 1401*r*, a phase shifter 1503, a reception amplifying unit 1505 (e.g., reception amplifier), and an ADC 1506.

If the control unit 1402 generates a digital pulse signal, the impulse signal generation unit 1501 generates an impulse signal in a UWB, having a waveform with a frequency band ranging from 3 to 10 GHz.

The transmission amplifying unit 1502 amplifies the impulse signal that is generated from the impulse signal generation unit 1501.

The transmission antenna 1401*t* radiates an impulse electromagnetic wave to the target area 1409 according to the impulse signal received from the transmission amplifying unit 1502.

While driving the phased-array antenna 1401*r* according to a phase-shifting value Dps that is received from the control unit 1402, the phase shifter 1503 outputs a reflection signal received from the phased-array antenna 1401*r* to the reception amplifying unit 1505.

Referring back to FIG. 6, the reception amplifying unit 1505, for example, a low noise amplifier (LNA), amplifies the reflection signal that is received from the phase shifter 1503 by a ratio, and removes a noise component from the amplified reflection signal.

Then, the ADC 1506 converts the reflection signal received from the reception amplifying unit 1505 into a digital signal, and outputs the digital signal to the control unit 1402.

Figure 16:
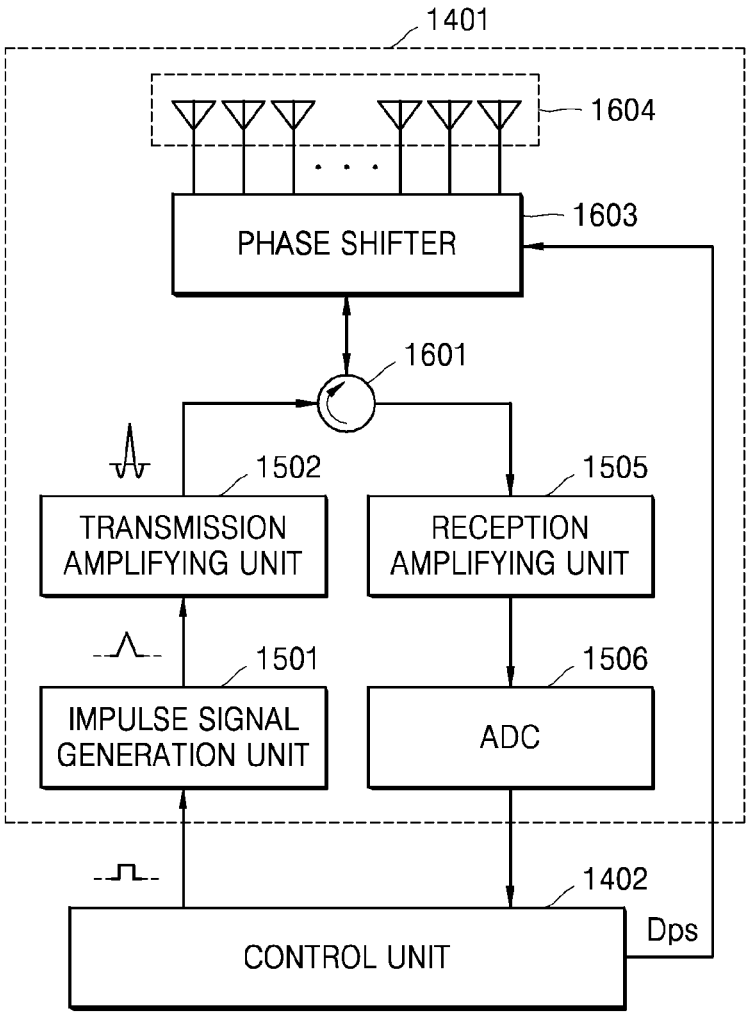
FIG. 16 is a diagram for showing a second example of the wireless transceiving unit shown in FIG. 14.

FIG. 16 is a diagram showing a second example of the wireless transceiving unit 1401 shown in FIG. 14. Like reference numerals shown in FIGS. 14 and 16 denote elements having the same function. With regard to the second example shown in FIG. 16, the transmission antenna 1401*t* shown in FIG. 14 and the phased-array antenna 1401*r* shown in FIG. 14 are replaced with one phased-array antenna 1604. Referring to FIG. 16, the second example of the wireless transceiving unit 1401 is as follows.

The wireless transceiving unit 1401 may include an impulse signal generation unit 1501, a transmission amplifying unit 1502, a circulator 1601, a phase shifter 1603, the phased-array antenna 1604, the reception amplifying unit 1505, and the ADC 1506.

If the control unit 1402 generates a digital pulse signal, the impulse signal generation unit 1501 generates an impulse signal in a UWB, having a waveform with a frequency band ranging from 3 to 10 GHz.

The transmission amplifying unit 1502 amplifies the impulse signal that is generated from the impulse signal generation unit 1501.

The circulator 1601 outputs an impulse signal which is received from the transmission amplifying unit 1502 to the phase shifter 1603, and outputs a reflection signal which is received from the phase shifter 1603 to the reception amplifying unit 704.

While driving the phased-array antenna 1604 according to a phase-shifting value Dps that is received from the control unit 1402, the phase shifter 1603 outputs an impulse signal received from the circulator 1601 to the phased-array antenna 1604 and outputs a reflection signal received from the phased-array antenna 1604 to the circulator 1601.

Referring back to FIG. 6, the reception amplifying unit 1505, for example, an LNA, amplifies the reflection signal that is received from the circulator 1601 by a ratio, and removes a noise component from the amplified reflection signal.

Then, the ADC 1506 converts the reflection signal received from the reception amplifying unit 1505 into a digital signal, and outputs the digital signal to the control unit 1402.

Figure 17:
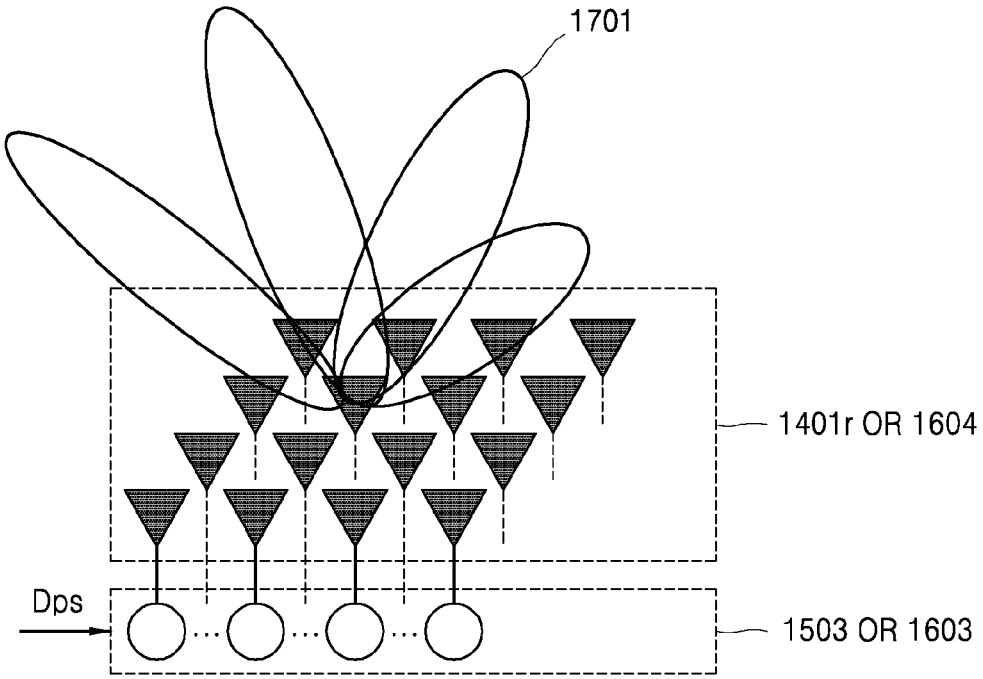
FIG. 17 is a diagram for explaining operations of a phase shifter and a phased-array antenna of FIG. 15 or 16.
Figure 18:
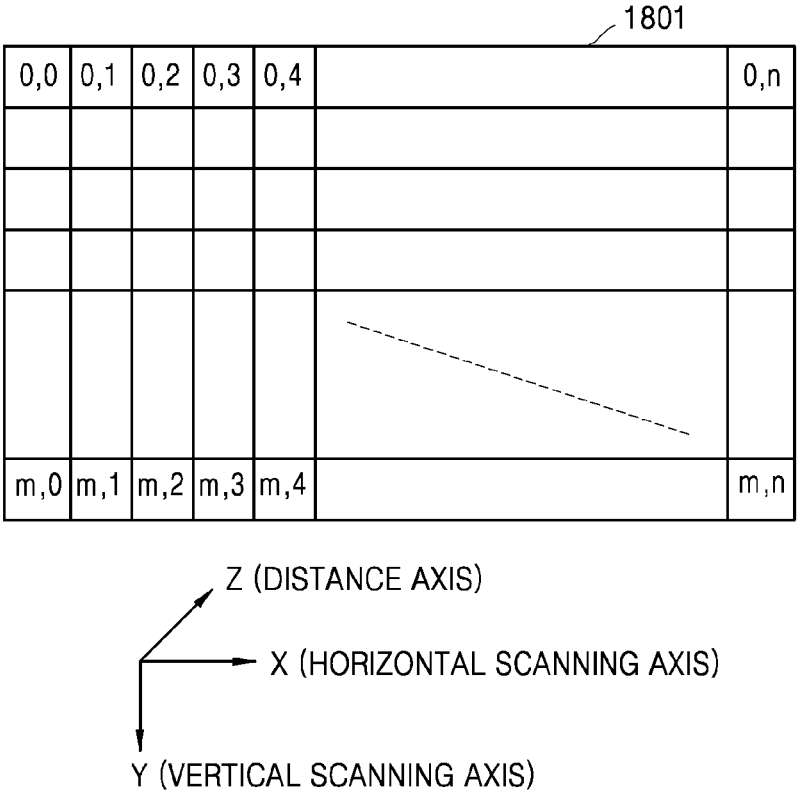
FIG. 18 is a diagram for showing position coordinates of set divided areas in the target area, according to operations of the phase shifter and the phased-array antenna of FIG. 17.

FIG. 17 is a diagram for explaining operations of the phase shifter 1503 or 1603 and the phased-array antenna 1401*r* or 1604 shown in FIG. 15 or 16. FIG. 18 shows position coordinates of set divided areas of the target area 1409 shown in FIG. 14, according to operations of the phase shifter 1503 or 1603 and the phased-array antenna 1401*r* or 1604, which are shown in FIG. 17. In FIG. 18, an X-axis refers to a horizontal scanning axis, a Y-axis refers to a vertical scanning axis, and a Z-axis refers to a distance axis.

A detailed description about a case in which the phase shifter 1503 and the phased-array antenna 1401*r* shown in FIG. 15 are employed is as follows.

Referring to FIGS. 14, 15, 17, and 18, while driving the phased-array antenna 1401*r* according to a phase-shifting value Dps that is received from the control unit 1402, the phase shifter 1503 outputs a reflection signal received from the phased-array antenna 1401*r* to the reception amplifying unit 1505.

Accordingly, the phased-array antenna 1401*r* may receive reflection signals 1701, having a narrow width, respectively from (m+1)×(n+1) set divided areas in the target area 1409.

A detailed description about an exemplary configuration in which the phase shifter 1603 and the phased-array antenna 1604 shown in FIG. 16 are employed is as follows. With regard to the second example shown in FIG. 16, the transmission antenna 1401*t* shown in FIG. 14 and the phased-array antenna 1401*r* shown in FIG. 14 are replaced with one phased-array antenna 1604.

Referring to FIGS. 14 and 16 through 18, while driving the phased-array antenna 1604 according to a phase-shifting value Dps that is received from the control unit 1402, the phase shifter 1603 outputs an impulse signal received from the circulator 1601 to the phased-array antenna 1604 and outputs a reflection signal received from the phased-array antenna 1604 to the circulator 1601.

Accordingly, the phased-array antenna 1401*r* may radiate an impulse electromagnetic wave respectively to the (m+1)×(n+1) set divided areas toward the target area 1409, and then, receive reflection signals respectively from the (m+1)×(n+1) set divided areas.

Figures 19, 20:
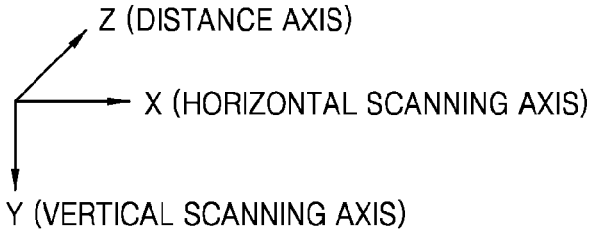
FIGS. 19 and 20 are diagrams for showing that the presence of people is respectively determined in the set divided areas shown in FIG. 18.

FIGS. 19 and 20 are diagrams for showing that the presence of people is respectively determined for the set divided areas shown in FIG. 18. In FIG. 20, an X-axis refers to a horizontal scanning axis, a Y-axis refers to a vertical scanning axis, and a Z-axis refers to a distance axis).

Referring to FIGS. 14, 17, 19, and 20, the phased-array antenna 1401*r* or 1604 may receive reflection signals 1701, each having a narrow width, respectively from set divided areas 2001 in the target area 1409.

Accordingly, a plurality of people M2 through M4, who are located a same distance from the people counting apparatus 140, may be accurately counted, instead of counting only one person.

Determination data 1901 and 2001 includes phase-shifting values of the phase shifter 1503 or 1603, position coordinates of respective set divided areas that correspond to the respective phase-shifting values, and a determination result. According to determination data shown in FIG. 20, it may be understood that 22 people are present in the target area 1409.

As described above, according to the exemplary embodiments of the people counting method and apparatus, people are counted according to a signal strength of a reflection signal of an impulse electromagnetic wave, by considering that the signal strength is weakened in proportion to a reception time.

A reception time of a reflection signal corresponds to a distance between a reception point (e.g., the people counting apparatus 201) and people. Accordingly, people may be counted based on a distance between the people counting apparatus 201 and people.

In other words, according to the exemplary embodiments of the people counting method and apparatus, people may be counted by using a reflection signal of an impulse electromagnetic wave, instead of using conventional camera technology. Accordingly, the following beneficial effects may be obtained.

First, people may be counted regardless of an environment of an unspecified target area. For example, people near an accident, such as a fire or a blackout, may be counted.

Second, a conventional problem where people feel uncomfortable when a camera is used may be solved.

Additionally, since an average value of values of counting results, which is obtained by performing repeated measurements, may be used according to certain exemplary embodiments, people may be counted more accurately.

Additionally, according to a state of a change in data regarding the presence of people, a status indicating when people exit or enter a target area may be recognized according to certain exemplary embodiment embodiments.

Additionally, according to certain exemplary embodiments of the people counting method and apparatus, a phased-array antenna is employed to receive a reflection signal from a target area. Thus, the phased-array antenna may receive reflective signals respectively from divided areas that are set towards the target area 1409. Accordingly, a plurality of people, who are located at a same distance from the people counting apparatus, may be accurately counted, instead of counting only one person.

As described above, according to the above exemplary embodiments of the people counting method and apparatus, people are counted according to a signal strength of a reflection signal of an impulse electromagnetic wave as a signal strength weakens in proportion to a reception time of the reflection signal. A reception time of the reflection signal corresponds to a distance between the people counting apparatus and people. It is understood, of course, that certain exemplary embodiments are not limited to counting people, and may be used to count many other types of living or non-living objects, e.g., livestock, etc.

It should be understood that the exemplary embodiments described therein should be considered in a descriptive sense only and not for purposes of limitation. Descriptions of features or aspects within each exemplary embodiment should typically be considered as available for other similar features or aspects in other exemplary embodiments.

While one or more exemplary embodiments have been described with reference to the figures, it will be understood by those of ordinary skill in the art that various changes in form and details may be made therein without departing from the spirit and scope of the exemplary embodiments as defined by the following claims.

What is claimed is:

1. An apparatus configured to count people in a target area, the apparatus comprising:

a wireless transceiver configured to radiate an impulse electromagnetic wave to the target area and receive a reflection signal from the target area; and a controller configured to obtain a signal strength of the reflection signal over a reception time period during which the reflection signal is received and count people according to the signal strength, considering that the signal strength is weakened in proportion to the reception time period, wherein the wireless transceiver comprises:

a phased-array antenna configured to receive the reflection signal from the target area;

an impulse signal generator configured to generate an impulse signal in an ultra-wide band (UWB) according to a digital pulse signal received from the controller;

a transmission amplifier configured to amplify the impulse signal received from the impulse signal generator;

a transmission antenna configured to radiate the impulse electromagnetic wave to the target area, according to the amplified impulse signal received from the transmission amplifier, a phase shifter configured to output the reflection signal that is received from the phased-array antenna to a reception amplifier while driving the phased-array antenna according to a phase-shifting value that is received from the controller;

the reception amplifier configured to amplify the reflection signal that is received from the phase shifter and output the amplified reflection signal to an analog-to-digital converter (ADC), and the ADC configured to convert the amplified reflection signal received from the reception amplifier into a digital signal, and output the digital signal to the controller.

2. An apparatus configured to count people in a target area, the apparatus comprising:

a wireless transceiver configured to radiate an impulse electromagnetic wave to the target area and receive a reflection signal from the target area; and a controller configured to obtain a signal strength of the reflection signal over a reception time period during which the reflection signal is received and count people according to the signal strength, considering that the signal strength is weakened in proportion to the reception time period, wherein the wireless transceiver further comprises:

a phased-array antenna configured to receive the reflection signal from the target area;

an impulse signal generator configured to generate an impulse signal in an ultra-wide band (UWB) according to a digital pulse signal received from the controller;

a transmission amplifier configured to amplify the impulse signal received from the impulse signal generator;

a circulator configured to output the amplified impulse signal received from the transmission amplifier to a phase shifter, and output the reflection signal received from the phase shifter to a reception amplifier, the phase shifter configured to output the amplified impulse signal received from the circulator to the phased-array antenna, and output the reflection signal received from the phased-array antenna to the circulator, while driving the phased-array antenna according to a phase-shifting value that is received from the controller;

the reception amplifier configured to amplify the reflection signal that is received from the circulator, and output the reflection signal to an analog-to-digital converter (ADC); and the ADC configured to convert the amplified reflection signal received from the reception amplifier into a digital signal, and output the digital signal to the controller.

3. A counting apparatus, comprising:

a wireless transceiver configured to radiate an impulse electromagnetic wave into a target area and receive the impulse electromagnetic wave reflected back from the target area as a reflection signal; and a controller configured to obtain a signal strength of the reflection signal over a reception time period during which the reflection signal is received and determine when people exit or enter the target area according to the signal strength, considering that the signal strength is weakened in proportion to the reception time period, wherein the wireless transceiver comprises:

a phased-array antenna configured to receive the reflection signal from the target area;

an impulse signal generator configured to generate an impulse signal in an ultra-wide band (UWB) according to a digital pulse signal received from the controller a transmission amplifier configured to amplify the impulse signal received from the impulse signal generator a transmission antenna configured to radiate the impulse electromagnetic wave to the target area, according to the amplified impulse signal received from the transmission amplifier, a phase shifter configured to output the reflection signal that is received from the phased-array antenna to a reception amplifier while driving the phased-array antenna according to a phase-shifting value that is received from the controller;

the reception amplifier configured to amplify the reflection signal that is received from the phase shifter and output the amplified reflection signal to an analog-to-digital converter (ADC), and the ADC configured to convert the amplified reflection signal received from the reception amplifier into a digital signal, and output the digital signal to the controller.

4. A counting apparatus, comprising:

a wireless transceiver configured to radiate an impulse electromagnetic wave into a target area and receive the impulse electromagnetic wave reflected back from the target area as a reflection signal; and a controller configured to obtain a signal strength of the reflection signal over a reception time period during which the reflection signal is received and determine when people exit or enter the target area according to the signal strength, considering that the signal strength is weakened in proportion to the reception time period, wherein the wireless transceiver comprises:

a phased-array antenna configured to receive the reflection signal from the target area;

an impulse signal generator configured to generate an impulse signal in an ultra-wide band (UWB) according to a digital pulse signal received from the controller;

a transmission amplifier configured to amplify the impulse signal received from the impulse signal generator;

a circulator configured to output the amplified impulse signal received from the transmission amplifier to a phase shifter, and output the reflection signal received from the phase shifter to a reception amplifier, the phase shifter configured to output the amplified impulse signal received from the circulator to the phased-array antenna, and output the reflection signal received from the phased-array antenna to the circulator, while driving the phased-array antenna according to a phase-shifting value that is received from the controller;

the reception amplifier configured to amplify the reflection signal that is received from the circulator, and output the reflection signal to an analog-to-digital converter (ADC), and the ADC configured to convert the amplified reflection signal received from the reception amplifier into a digital signal, and output the digital signal to the controller.

* * * * *